US005720699A

United States Patent [19]

Musachio et al.

[11] Patent Number: 5,720,699

[45] Date of Patent: Feb. 24, 1998

[54] EXERCISE METHOD AND APPARATUS

[76] Inventors: Nicholas R. Musachio, 862 Iowa Ave. W., St. Paul, Minn. 55117-3476; Edward J. Schmit, 935 Julie Dr., St. Cloud, Minn. 56303

[21] Appl. No.: 756,077

[22] Filed: Nov. 25, 1996

[51] Int. Cl.[6] ..... A63B 21/02

[52] U.S. Cl. ..... 482/122; 482/124; 482/121

[58] Field of Search ..... 422/121, 122, 422/125, 126, 49

[56] References Cited

U.S. PATENT DOCUMENTS 3,445,109 5/1969 Kolbel ..... 482/125

4,783,067 11/1988 Palmer ..... 482/122

4,865,317 9/1989 Hickey ..... 482/126

5,125,878 6/1992 Wingate et al. ..... 482/49

5,556,359 9/1996 Clementi ..... 482/49

*Primary Examiner*—Lynne A. Reichard

*Attorney, Agent, or Firm*—Merchant, Gould, Smith, Edell, Welter & Schmidt, P.A.

[57] ABSTRACT

An exercise member is slidably mounted on the parallel rails of a generally U-shaped frame. Resilient members resist movement of the exercise member in either direction from a point of equilibrium along the rails.

20 Claims, 2 Drawing Sheets

EXERCISE METHOD AND APPARATUS

FIELD OF THE INVENTION

The present invention relates to exercise methods and apparatus and more particularly, to the provision of resistance to movement of an exercise member in either of two opposite directions from a point of equilibrium.

BACKGROUND OF THE INVENTION

Exercise is widely accepted as a way to improve one's fitness and health. Even for individuals who are motivated to exercise, impediments often arise in the form of inconvenience and/or insufficient resources. For example, a need exists for exercise equipment which can be readily transported to and/or used in relatively poorly suited environments, such as hotel rooms. A need also exists for exercise equipment which is relatively inexpensive to manufacture yet nonetheless effective in use.

SUMMARY OF THE INVENTION

In one respect, the present invention may be seen to provide an exercise apparatus having a frame; an exercise member movably mounted on the frame; and a means for resisting movement of the exercise member in either of two opposite directions relative to the frame. An advantage of this arrangement is that from one position a person can selectively work either or both of the extensor and flexor muscles associated with a particular limb. In another respect, the present invention may be seen to provide an exercise apparatus having a frame; an exercise member movably mounted on the frame; and resilient members interconnected between the exercise member and opposite ends of the frame and operable to resist movement of the exercise member in either of two opposite directions relative to the frame. An advantage of this arrangement is that during the recovery portion of an exercise motion, the opposing resilient members tend to discourage excessive "snapping back" of the exercise member toward an equilibrium position.

In yet another respect, the present invention may be seen to provide an exercise apparatus having a U-shaped frame; an exercise member slidably mounted on opposing rails of the frame; and means for providing resistance to movement of the exercise member along the rails. An advantage of this arrangement is that the apparatus is relatively easy to hold and manipulate between two body members, such as the torso and the hands.

Many of the advantages of the present invention will become apparent to those skilled in the art upon a more detailed description of the preferred embodiment.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
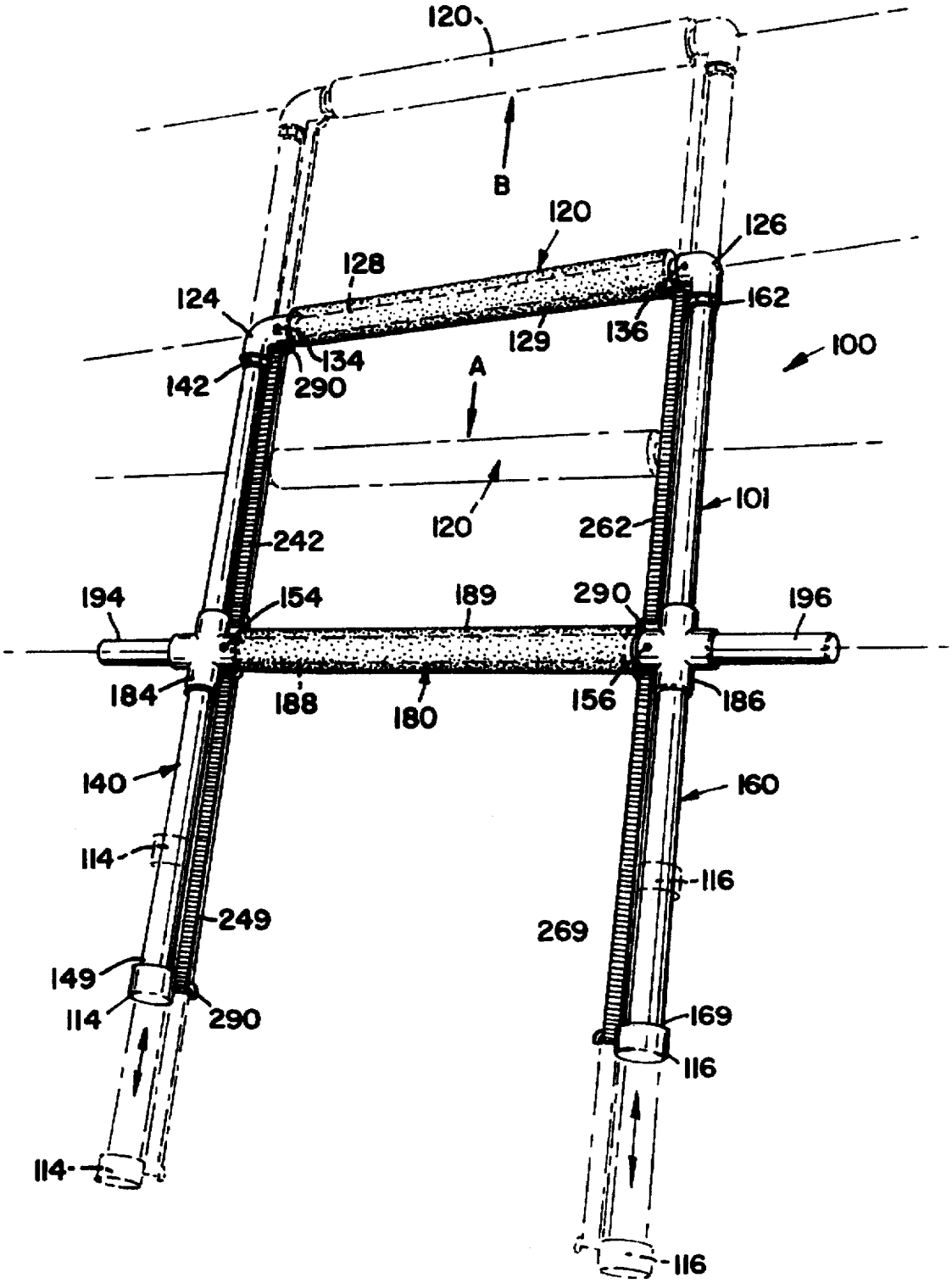
FIG. 1 is a perspective view of an exercise apparatus constructed according to the principles of the present invention.

An exercise apparatus constructed according to the principles of the present invention is designated as 100 in FIG.

1. The exercise apparatus 100 generally includes a base member 120, a first guide member 140, a second guide member 160, an exercise member 180, and resistance members 242, 249, 262, and 269.

The base member 120 includes a first coupler or 90 degree elbow joint 124, a second coupler or 90 degree elbow joint 126, and a cylindrical tube 128. The cylindrical tube 128 has outside and inside diameters equal to those of each of the guide members 140 and 160. A foam tube 129 slides onto the rigid tube 128 to provide a more comfortable support against which a person may push or pull.

One end of the first coupler 124 is rigidly secured to a base end 142 of the first guide member 140, by adhesive or any other suitable means. One end of the second coupler 126 is rigidly secured to a base end 162 of the second guide member 160, by adhesive or any other suitable means. A separate hole is formed in the cylindrical sidewall of each of the couplers 124 and 126, proximate the ends opposite the respective guide members 140 and 160. Corresponding holes are formed through the cylindrical sidewall of the tube 128 proximate each end thereof. Snap buttons, of the type known in the art, are inserted into opposite ends of the tube 128, so that buttons 134 and 136 protrude out respective holes. One end of the tube 128 is then inserted or "telescoped" into the first coupler 124 and arranged so that the button 134 engages the hole through the sidewall thereof. The other end of the tube 128 is then inserted or "telescoped" into the second coupler 126 and arranged so that the button 136 engages the hole through the sidewall thereof. In this manner, the tube 128 is releasably interconnected between the guide members 140 and 160.

The first guide member 140 extends linearly from its base end 142 to a remote end 149. The second guide member 160 extends linearly from its base end 162 to a remote end 169. The guide members 140 and 160 extend parallel to one another and perpendicularly away from the base member 120. In other words, the guide members 140 and 160 cooperate with the base member 120 to define a generally U-shaped frame 101.

The exercise member 180 includes a third coupler or four-way joint 184, a fourth coupler or four-way joint 186, and a cylindrical tube 188. The cylindrical tube 188 has outside and inside diameters equal to those of each of the guide members 140 and 160. A foam tube 189 slides onto the rigid tube 188 to provide a more comfortable support against which a person may push or pull.

The third coupler 184 is slidably mounted on the first guide member 140, and the fourth coupler 186 is slidably mounted on the second guide member 160. A separate hole is formed in an inwardly projecting, cylindrical sidewall of each of the couplers 184 and 186, and corresponding holes are formed through the cylindrical sidewall of the tube 188 proximate each end thereof. Snap buttons, of the type known in the art, are inserted into opposite ends of the tube 188, so that buttons 154 and 156 protrude out respective holes. One end of the tube 188 is then inserted or "telescoped" into the third coupler 184 and arranged so that the button 154 engages the hole through the inwardly projecting sidewall thereof. The other end of the tube 188 is then inserted or "telescoped" into the fourth coupler 186 and arranged so that the button 156 engages the hole through the sidewall thereof. In this manner, the tube 180 is slidably mounted on the guide members 140 and 160, and releasably interconnected therebetween.

Handles 194 and 196 are secured to outwardly projecting, cylindrical sidewalls on the couplers 184 and 186. The handles 194 and 196 are cylindrical tubes having outer and inner diameters equal to those of the tube 188. The handles 194 and 196 are inserted or "telescoped" into respective holes on respective couplers 184 and 186 and rigidly secured in place by adhesive or any other suitable means. The handles 194 and 196 are co-linear with the tube 188.

A stop 114 is secured to the remote end 149 of the first guide member 140 and cooperates with the first coupler 124 to capture the third coupler 184 therebetween. A stop 116 is secured to the remote end 169 of the second guide member 160 and cooperates with the second coupler 126 to capture the fourth coupler 186 therebetween. Each stop 114 and 116 has outside and inside diameters equal to those of the couplers 124, 126, 184, and 186. Each stop 114 and 116 may be secured to a respective guide member 140 and 160 by a snap button or any other suitable means.

The first resistance member 242 is interconnected between the third coupler 184 and the first coupler 124, proximate the base end 142 of the first guide member 140. The second resistance member 249 is interconnected between the third coupler 184 and the stop 114, proximate the remote end 149 of the first guide member 140. The third resistance member 262 is interconnected between the fourth coupler 186 and the second coupler 126, proximate the base end 162 of the second guide member 160. The fourth resistance member 169 is interconnected between the fourth coupler 186 and the stop 116, proximate the remote end 169 of the second guide member 160.

Each of the resistance members 242, 249, 262, and 269 is an elastic cord having opposite ends formed into closed loops. Each closed loop fits snugly over the head of a bolt 290 protruding from a respective member 124, 126, 184, 186, 114, and 116. The elasticity of the cords allows the loops to stretch over the respective heads and then contract to retain the cord ends in place, regardless of whether any given cord is taut or not. Those skilled in the art will recognize additional arrangements that could be used in the alternative. For example, elastic bands (formed into closed loops) could be stretched about hooks protruding from each of the members.

When the apparatus 100 is not being used, each of the resistance members 242, 249, 262, and 269 is in tension, and the exercise member 180 occupies a point of equilibrium intermediate the base ends 142 and 162 and the remote ends 149 and 169 of the guide members 140 and 160, respectively. When all four resistance members 242, 249, 262, and 269 have equal lengths and spring constants, this point of equilibrium is proximate the midpoints of the guide members 140 and 160.

Relative movement of the exercise member 180 and the base member 120 toward one another (see arrow A) increases tension in the resistance members 249 and 269 and decreases tension in the resistance members 242 and 262. On the other hand, relative movement of the exercise member 180 and the base member 120 away from one another (see arrow B) increases tension in the resistance members 242 and 262 and decreases tension in the resistance members 249 and 269. When the exercise member 180 is effectively released and allowed to return to the point of equilibrium, the opposing resistance members tend to minimize snapping or overshooting of the exercise member 180.

A person can use the apparatus 100 to perform a variety of exercises. For example, a person can perform a "chest press" exercise by placing the base 120 behind the upper back, extending the hands generally forward, grasping the handles 194 and 196 in opposite hands, and pressing outward with the arms; a person can perform a "fly" exercise by extending the hands generally forward, grasping the center of the base 120 in one hand, grasping the center of the exercise member 180 in the other hand, and pressing the hands toward one another; a person can perform a "sitting knee curl" exercise by sitting on a chair, capturing the base 120 between the floor and at least one foot, resting the elbows on the knees with the hands extending generally forward, grasping the handles 194 and 196 in opposite hands, and pulling upward and inward on the handles 194 and 196; a person can perform a "standing curl" exercise by placing the base 120 behind the buttocks, extending the hands generally downward, grasping the handles 194 and 196 in opposite hands, and pulling upward and inward on the handles 194 and 196; a person can perform a "military press" exercise by placing the base 120 behind the head and across the shoulders, extending the hands generally above the head, grasping the handles 194 and 196 in opposite hands, and pulling downward on the handles 194 and 196; a person can perform a "squat" exercise by placing the base 120 on the floor, standing on the base 120, extending the hands generally downward, grasping the handles 194 and 196 in opposite hands, and pulling upward on the handles 194 and 196; a person can perform a "sit up" exercise by sitting on a chair, placing the base 120 across the lap, capturing the exercise member 180 beneath the arms, and pushing downward on the exercise member 180; a person can perform an "inner thigh squeeze" exercise by sitting on a chair, placing one knee against the outside of the base 120, placing the other knee against the outside of the exercise member 180, and pressing the knees toward one another; and/or a person can perform an "outer thigh exercise by sitting on a chair, placing one knee against the inside of the base 120, placing the other knee against the inside of the exercise member 180, and pressing the knees away from one another. When not in use, the apparatus 100 may be collapsed, by removing the tubes 128 and 188, to facilitate storage and/or transportation of the apparatus 100.

If adjustability of the length of stroke or the amount of resistance is desired, the stops 114 and 116 may be selectively moved relative to respective guide members 140 and 160. For example, ball-detent pins, of the type known in the art, could cooperate with single holes through respective stops 114 and 116 and series of holes through respective guide members 140 and 160 to lock the stops 114 and 116 in any of a plurality of positions along the guide members 140 and 160. Similarly, the bolts 290 nearest the base member 120 could be secured to respective guide members 140 and 160 by means of ball-detent pins and series of holes through the guide members 140 and 160. Alternatively, the couplers 124 and 126 could be replaced by T-shaped couplers which could be slidably mounted on the guide members 140 and 160 and releasably secured in any of several locations by ball-detent pins.

Those skilled in the art will also recognize that more than one exercise member may be mounted on the guide members 140 and 160 to facilitate additional exercises and/or resistance curves. If a second exercise member were added, the resistance members 249 and 269 would be interconnected between the exercise member 180 and the additional exercise member, and an additional pair of resistance members would be interconnected between the additional exercise member and the remote ends of the guide members.

Figure 2:
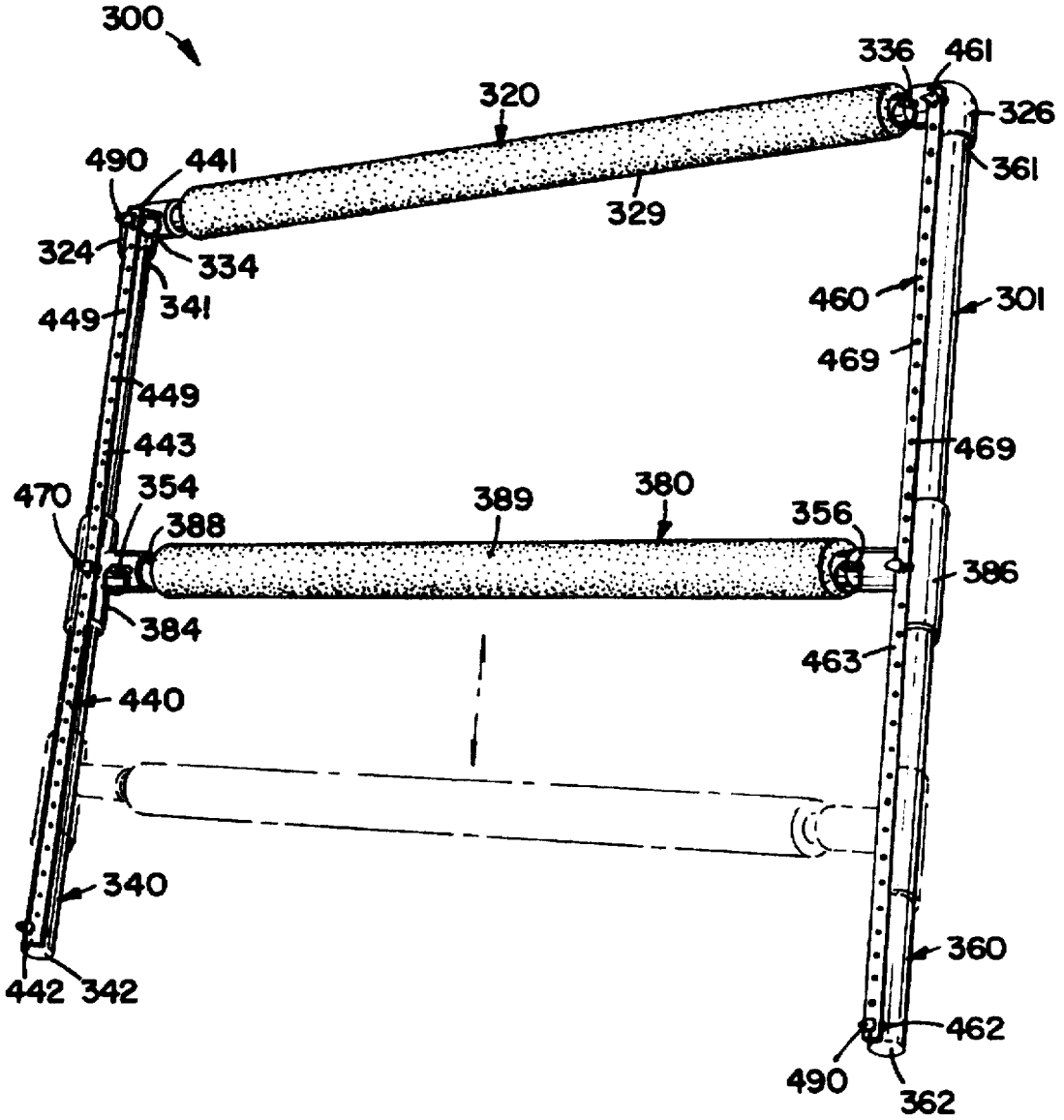
FIG. 2 is a perspective view of a second exercise apparatus constructed according to the principles of the present invention.

Although the present invention has been described with reference to a preferred embodiment and a specific application, those skilled in the art will recognize other embodiments and applications that fall within the scope of the present invention. For example, a second embodiment of the present invention is designated as 300 in FIG. 2.

The apparatus 300 is similar in many respects to the first embodiment 100. Among other things, the apparatus 300 also includes a generally U-shaped frame 301 which supports a moveable cross bar 380. The frame 301 includes a base member 320, a first rail 340, and a second rail 360. A foam tube 329 slides onto the base member 320 to provide a comfortable support against which a person may push or pull. The first rail 340 extends between a first end 341, which is connected to one end of the base 320 by means of a coupler 324 and a ball-detent pin 334, and a second, distal end 342. Likewise, the second rail 360 extends between a first end 361, which is connected to an opposite end of the base 320 by means of a coupler 326 and a ball-detent pin 336, and a second, distal end 362.

The cross bar or exercise member 380 includes a third coupler or T joint 384, a fourth coupler or T joint 386, and a cylindrical tube 388. A foam tube 389 slides onto the rigid tube 388 to provide a more comfortable support against which a person may push or pull. The third coupler 384 is slidably mounted on the first guide member 340, and the fourth coupler 386 is slidably mounted on the second guide member 360. Opposite ends of the tube 388 are secured to respective couplers 384 and 386 by means of ball-detent pins 354 and 356 of the type known in the art.

Contrary to the first embodiment 100, the second embodiment 300 does not include outwardly projecting handles on the exercise member 380, and thus, the tube 388 and the base member 320 are relatively longer on the second embodiment 300. Also, the resistance mechanism on the second embodiment 300 is somewhat different than that on the first embodiment 100. In particular, a single, integral elastic member 440 or 460 extends along each of the guide members 340 and 360 on the frame 301.

A first end 441 of the first resilient member 440 is secured to the frame 301 proximate the base 320. A second, opposite end 442 of the first resilient member 440 is secured to the frame 301 proximate the distal end 342 of the first guide member 340. An intermediate portion 443 of the first resilient member 440, disposed between the first end 441 and the second end 442, is secured to the cross bar 380. Similarly, a first end 461 of the second resilient member 460 is secured to the frame 301 proximate the base 320; second, opposite end 462 of the second resilient member 460 is secured to the frame 301 proximate the distal end 362 of the second guide member 360; and an intermediate portion 463 of the second resilient member 460, disposed between the first end 461 and the second end 462, is secured to the cross bar 380.

Each connection between a respective resilient member 440 or 460 and a respective frame member or exercise member is effected by means of a post 490 extending outward from the frame 301 or the cross bar 380 and any of several holes 449 or 469 through the intermediate portion 443 or 463, respectively. Each post 490 has an enlarged head which is greater in diameter than the unstretched holes 449 and 469. In other words, the resilient members 440 and 460 are configured to be secured over the posts 490 by force fit.

The provision of a single resilient member on each side of the frame 301 facilitates adjustments to the apparatus 300 because only the posts 490 on the cross bar 380 need be disconnected from the resilient members 440 and 460 in order to reposition the cross bar 380 relative to the frame 301 and change the resistance provided for a particular exercise. Discrete indicia may be disposed on the resilient members 440 and 460 for each pair of directly opposing holes to facilitate comparable adjustments on both sides of the apparatus 300. Like the first embodiment 100, the second embodiment 300 can be broken down for transportation and/or storage purposes, and the second embodiment 300 may be used for a variety of exercises.

In view of the many variations on the present invention which are likely to be recognized by those skilled in the art, the scope of the present invention is to be limited only to the extent of the appended claims.

What is claimed is:

1. An exercise apparatus, comprising:

a rigid support extending between a base end and a remote end;

an exercise member movably mounted on the rigid support;

a first resilient member interconnected between the exercise member and the base end of the rigid support, the first resilient member being a first portion of an elastic cord; and a second resilient member interconnected between the exercise member and the remote end of the rigid support, the second resilient member being a second portion of the elastic cord;

wherein the exercise member rests at a point of equilibrium intermediate the base end and the remote end.

2. The exercise apparatus of claim 1, wherein the first resilient member and the second resilient member are essentially equal in length and spring constant, whereby the point of equilibrium is essentially equidistant from the base end and the remote end.

3. The exercise apparatus of claim 1, wherein the rigid support is elongate.

4. The exercise apparatus of claim 1, wherein the exercise member slides along the elongate rigid support.

5. An exercise apparatus, comprising:

a generally U-shaped frame which includes a base member; a first guide member connected to the base member and extending generally perpendicular thereto; and a second guide member connected to the base member and extending generally perpendicular thereto and generally parallel to the first guide member;

an exercise member movably mounted on the first guide member and the second guide member, wherein the exercise member and the frame cooperate to define a closed loop and the exercise member includes a first coupler slidably mounted on the first guide member, a second coupler slidably mounted on the second guide member and a cross bar releasably interconnected therebetween;

a first resilient member interconnected between the exercise member and at least one of the base member, the first guide member, and the second guide member; and a second resilient member interconnected between the exercise member and at least one of the base member, the first guide member, and the second guide member.

6. The exercise apparatus of claim 5, wherein the first resilient member is interconnected between the exercise member and the frame proximate the base member, and the first resilient member is disposed proximate and generally parallel to the first guide member, and the second resilient member is interconnected between the exercise member and the frame proximate the base member, and the second resilient member is disposed proximate and generally parallel to the second guide member.

7. The exercise apparatus of claim 6, further comprising a third resilient member interconnected between the exercise member and a remote end of the first guide member, and a fourth resilient member interconnected between the exercise member and a remote end of the second guide member.

8. The exercise apparatus of claim 6, wherein the first resilient member is an elastic cord having opposite ends formed into closed loops, and a first bolt, having an oversized head, extends outward from the exercise member to receive and retain one of the closed loops, and a second bolt, having an oversized head, extends outward from the base member to receive and retain another of the closed loops.

9. The exercise apparatus of claim 5, wherein the exercise member includes first and second handles disposed outside opposite sides of the closed perimeter and extending in opposite directions from the exercise member.

10. The exercise apparatus of claim 5, wherein the cross bar extends between a first end and a second end, and the first end and the first coupler telescope relative to one another and are releasably connected to one another by a snap button disposed within one of the first end and the first coupler, and the second end and the second coupler telescope relative to one another and are releasably connected to one another by a snap button disposed within one of the second end and the second coupler.

11. The exercise apparatus of claim 5, wherein the exercise member includes a first handle rigidly secured to the first coupler outside the closed loop and extending generally parallel to the cross bar, and a second handle rigidly secured to the second coupler outside the closed loop and extending generally parallel to the cross bar.

12. The exercise apparatus of claim 5, wherein the base member includes a third coupler rigidly secured to the first guide member, a fourth coupler rigidly secured to the second guide member, and a tube extending between a first end and a second end, and the first end of the tube and the third coupler telescope relative to one another and are releasably connected to one another by a snap button disposed within one of the first end of the tube and the third coupler, and the second end of the tube and the fourth coupler telescope relative to one another and are releasably connected to one another by a snap button disposed within one of the second end of the tube and the fourth coupler.

13. The exercise apparatus of claim 5, wherein the base member is padded to provide a first comfortable support against which a person may exert force, and the exercise member is padded to provide a second comfortable support against which a person may exert force.

14. The exercise apparatus of claim 5, wherein the first resilient member has a first end connected to the frame proximate the base member, a second end connected to the frame proximate a distal end of the first guide member, and an intermediate portion connected to the exercise member, and the second resilient member has a first end connected to the frame proximate the base member, a second end connected to the frame proximate a distal end of the second guide member, and an intermediate portion connected to the exercise member.

15. An exercise apparatus, comprising:

a base member having a first end and a second end;

a first guide member having a base end and a remote end, wherein the base end of the first guide member is connected to the first end of the base member, and the first guide member extends perpendicularly away from the base member;

a second guide member having a base end and a remote end, wherein the base end of the second guide member is connected to the second end of the base member, and the second guide member extends parallel to the first guide member;

an exerciser member having a first end and a second end, wherein the first end of the exercise member is slidably mounted on the first guide member, and the second end of the exercise member is slidably mounted on the second guide member; and a resistance means, connected to the exercise member, for resisting movement of the exercise member relative to the base member;

wherein the base member includes a cylindrical tube, the first guide member includes a cylindrical tube, the second guide member includes a cylindrical tube, and the exercise member includes a cylindrical tube.

16. The exercise apparatus of claim 15, wherein the resistance means includes a resilient member interconnected between the exercise member and the base, proximate the first guide member, and another resilient member interconnected between the exercise member and the base, proximate the second guide member.

17. The exercise apparatus of claim 16, wherein the resistance means includes a third resilient member interconnected between the exercise member and the remote end of the first guide member, and a fourth resilient member interconnected between the exercise member and the remote end of the second guide member.

18. The exercise apparatus of claim 17, wherein the resilient member and the third resilient member are integrally joined to one another, and the another resilient member and the fourth resilient member are integrally joined to one another.

19. The exercise apparatus of claim 15, wherein the resistance means includes a resilient member interconnected between the exercise member and the remote end of the first guide member, and another resilient member interconnected between the exercise member and the remote end of the second guide member.

20. The exercise apparatus of claim 15, wherein the base member includes a first coupler rigidly secured to the base end of the first guide member, a second coupler rigidly secured to the base end of the second guide member, and a tube releasably interconnected between each coupler by means of a snap button, and the exercise member includes a third coupler slidably mounted on the first guide member, a fourth coupler slidably mounted on the second guide member, and a tube interconnected between each coupler by means of a snap button.

* * * * *